United States Patent [19]

Utter

[11] 3,930,377

[45] Jan. 6, 1976

[54] ICE TRANSPORT SYSTEM

[75] Inventor: Robert P. Utter, Albert Lea, Minn.

[73] Assignee: King-Seeley Thermos Co., Ann Arbor, Mich.

[22] Filed: Sept. 17, 1973

[21] Appl. No.: 398,538

[52] U.S. Cl. ..... 62/344; 138/177; 138/178; 285/354; 302/2 R; 302/64

[51] Int. Cl.[2] ..... F25C 5/18

[58] Field of Search ..... 62/344; 243/1, 3, 4, 38; 302/64, 2 R; 138/155, DIG. 11, 177, 178, 157; 285/179, 183, 55, 354

[56] References Cited

UNITED STATES PATENTS

| | | | |
|---|---|---|---|
| 599,267 | 2/1898 | Smith | 285/354 |
| 1,284,064 | 11/1918 | De Lano | 138/156 |
| 1,413,727 | 4/1922 | Hanly | 302/2 R |
| 2,834,059 | 5/1958 | Hoezel | 302/64 |
| 2,953,806 | 9/1960 | Walker | 302/64 |
| 3,125,116 | 3/1964 | Schaberg | 302/2 R |
| 3,248,071 | 4/1966 | Cook | 302/2 R |
| 3,305,192 | 2/1967 | Todt et al. | 243/1 |
| 3,525,482 | 8/1970 | Kramer | 243/38 |
| 3,769,809 | 11/1973 | Robinson et al. | 62/137 |
| R23,091 | 3/1949 | Ford | 285/179 |

FOREIGN PATENTS OR APPLICATIONS

| | | | |
|---|---|---|---|
| 890,013 | 9/1953 | Germany | 285/179 |

*Primary Examiner*—William F. O'Dea
*Assistant Examiner*—William E. Tapolcai, Jr.
*Attorney, Agent, or Firm*—Harness, Dickey & Pierce

[57] ABSTRACT

A conduit structure for use in an ice transport system consisting of a plurality of individual conduit members, the adjacent ends of which are interconnected by conduit couplings, the conduit structure being of the one-piece uniform cross-section construction and including an intermediate section and first and second opposite end sections which are of a relatively linear configuration, the conduit structure further including first and second relatively arcuate sections interposed one between the first end section and the intermediate section and the other interposed between the intermediate section and the second end section, whereby the conduit structure can be severed within the intermediate section thereof to provide two separate conduit parts, each having a non-linear intermediate section and relatively linear opposed end sections adapted for operative association with the conduit couplings.

1 Claim, 5 Drawing Figures

ICE TRANSPORT SYSTEM

BACKGROUND AND SUMMARY OF THE INVENTION

This invention relates generally to ice making and storage apparatus and more particularly, to an ice transport system for conveying ice between remotely located ice producing machines and storage containers or bins.

It has heretofore been the practice to communicate ice which is produced, for example, by means of a flaked ice machine, to a remotely located storage chamber through an elongated continuous hose or conduit. Such hoses or conduits have been satisfactory from the standpoint of providing for a smooth, uninterrupted communication of ice; however, such continuous conduits have been objectionable from a maintenance and cleaning standpoint due to the fact that it is extremely difficult to effectively clean relatively long sections of conduit so as to satisfy the rigorous sanitary standards imposed by federal, state and municipal regulatory authorities.

The applicant's conduit structure will find particularly useful application in that the structure is designed so as to be compatible with conventional conduit couplings which must be secured to relative linear, i.e., non-curved, conduit sections. Toward this end, the applicant's conduit structure is designed such that it may be severed at an intermediate portion thereof to provide two conduit elements, each of which is adapted to provide for a change in direction, as well as provide for convenient assembly or operative association with the standard conduit coupling assemblies.

It is accordingly a general object of the present invention to provide a new and improved ice transport system.

It is a more particular object of the present invention to provide a new and improved ice transport system for use in flaked ice producing and storing systems.

It is another object of the present invention to provide a new and improved conduit structure for use in ice transport systems which minimizes back pressure resistance to the extreme and provides for compatible assembly of the conduit structure with coupling assemblies of the type well known in the art.

It is still another object of the present invention to provide a new and improved conduit structure which is of a simple design, is economical to manufacture and will have long and durable operational life.

It is still a further object of the present invention to provide a new and improved conduit structure that will find universality of application in various types of ice making machines.

DESCRIPTION OF THE PREFERRED EMBODIMENT

Figure 1:
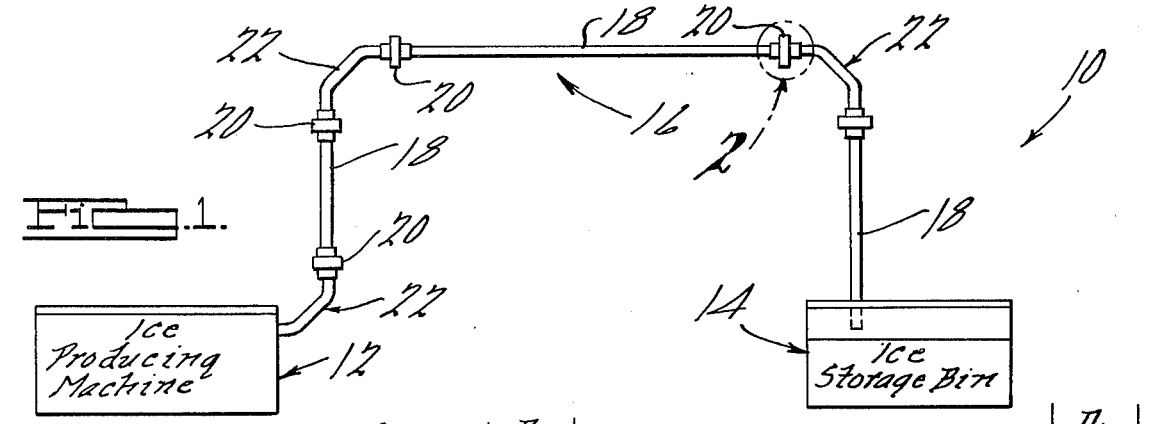
FIG. 1 is a schematic illustration of a typical ice transport system embodying the principles of the present invention therein.

Referring now in detail to the drawing and in particular to FIG. 1 thereof, an ice producing and storage system 10 is shown generally as comprising an ice making machine 12 and an ice storage enclosure or container 14 that is located remote from the machine 12. Disposed between and operatively connecting the machine 12 and storage container 14 is an ice transmitting or conveying conduit system 16 which is intended to convey ice produced by the machine 12 to the container 14 where ice may be stored or put to any suitable use. The ice making machine 12 may be of any suitable type adapted to produce flaked ice which is of a relatively fluent character, whereby such ice may be easily conveyed through the conduit system 16 to the container 14. A typical ice making machine which may be incorporated in the system 10 is shown and described in copending U.S. Pat. application, Ser. No. 269,609, filed June 12, 1972, now letter Pat. No. 3,820,354 which is incorporated by reference herein.

The conduit system 16 may assume various configurations depending upon the particular installation thereof and the relative orientation or location of the machine 12 relative to the container 14. It will therefore be appreciated that the conduit system 16 depicted in FIG. 1 is merely exemplary in nature and is in no way intended to limit the fair meaning of the claims appended hereto. By way of example, the conduit system 16 is shown as comprising a plurality of serially connected, uniform diameter tubular or conduit sections consisting of a plurality of straight sections 18 which are interconnected by means of a plurality of coupling assemblies 20 and conduit structures 22 in a manner so as to provide for the smooth and effortless transferring of ice from the machine 12 to the container 14.

The conduit sections 18 and conduit structures 22 are fabricated preferably, although not necessarily, of a relatively rigid polymeric material, such as polyvinyl chloride (PVC) or other suitable material which may be economically fabricated and possesses the requisite stable and sanitary characteristics, as will be appreciated by those skilled in the art. The coupling assemblies 20 are utilized at the abutting or adjoining ends of the various conduit sections 18 and/or conduit structures 22 for operatively connecting the same and are designed so that they may be easily disassembled to provide for the cleaning and related sanitary maintenance of the system 10.

Figure 3:
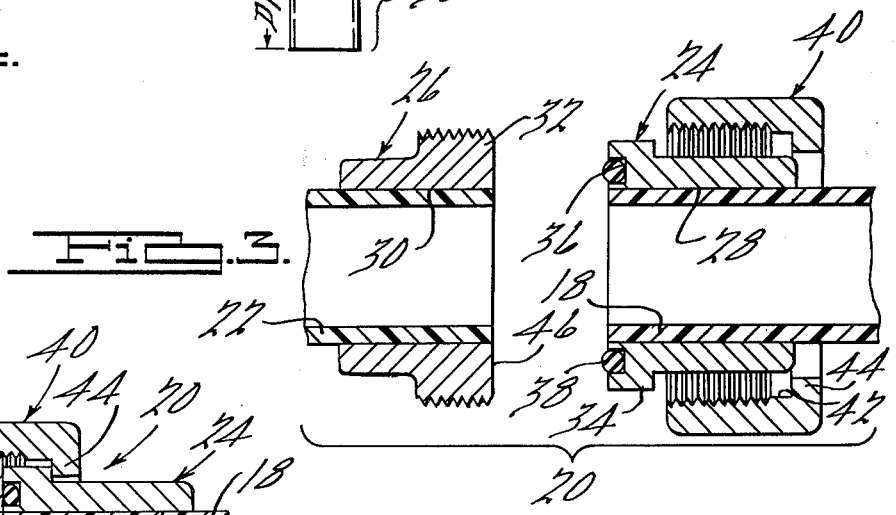
FIG. 3 is an exploded assembly view of the coupling assembly shown in FIG. 2.
Figure 2:
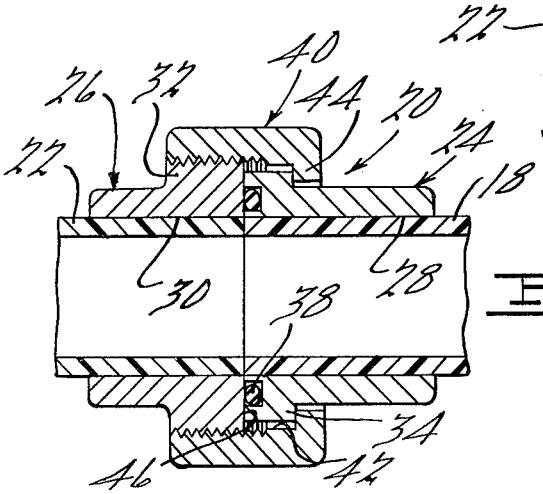
FIG. 2 is an enlarged fragmentary cross-sectional view of one of the coupling assemblies associated with the conduit system embodied in the structure shown in FIG. 1.

Reference will be made to FIGS. 2 and 3 wherein a typical coupling assembly 20 is shown as comprising a pair of coupling members 24, 26 which are formed with internal bores 28 and 30, respectively, the diameter of which is approximately equal to the outer diameter of the various conduit sections constituting the conduit section 16. The coupling member 26 is shown as comprising a radially outwardly projecting externally threaded shoulder 32 and is adapted, for example, to have one end of one of the conduit structures 22 nestingly received within the bore 30 thereof. The coupling member 24 is also formed with a radially outwardly projecting enlarged diameter shoulder 34, with the radially extending face adjacent thereto being formed with an annular recess 36 within which an O-ring sealing element 38 is disposed. As illustrated, the bore 28 of the coupling member 26 is adapted to nestingly receive, for example, one end of an adjacent conduit section 18, with the assembly 20 being operable to secure the conduit sections 18 and 22 in end-to-end abutting relation so as to provide a smooth relatively continuous flow path for ice therebetween. Each of the coupling assemblies 20 also includes a threaded collar member 40, one of which is shown in FIGS. 2 and 3 as having an internally threaded bore 42 which is slightly larger in diameter than the outer diameter of the main body of the coupling member 24, with the result that the threaded collar 40 is adapted to move coaxially and rotationally of the coupling member 26. The threaded collar 40 is formed with a radially inwardly projecting shoulder 44 which is adapted to abut against the shoulder 34 of the coupling member 24 at such time as the collar 40 is threadably engaged with the shoulder 32 of the coupling member 26, resulting in the members 24, 26 being urged axially toward one another and the sealing element 38 being forced into tight sealing engagement with a radially disposed end face on the coupling member 26, as best seen in FIG. 2.

Referring now in detail to the construction of the conduit structure 22, in accordance with one preferred embodiment of the present invention, the structure 22 is of a one-piece tubular construction and comprises a pair of straight or linear end sections 48 and 50 which lie along axes arranged perpendicular or at right angles to one another. The conduit structure 22 also comprises an intermediate linear or straight section 52 which lies along an axis arranged at 45° angles to the respective axes of the sections 48 and 50. The conduit structure 22 further comprises a pair of arcuate sections 54 and 56, the former of which is serially connected between the linear sections 48 and 52 and the latter of which is serially connected between the linear sections 50 and 52. In accordance with one of the principles of the present invention, it will be seen that ice transmitted through the conduit structure 22 may undergo a change of direction of 90°, yet at no time is it subjected to passing through an arcuate section of conduit having a projected angle of greater than 45°. In accordance with a preferred construction of the present invention, the linear or axial lengths of sections 48, 50 are approximately equal and are herein designated by the dimension $D_1$. The length of the linear intermediate section 52, on the other hand, is preferably of a dimension designated as $D_2$ which is preferably approximately equal to twice the dimension $D_1$, with the result that the following relationship exists between the sections 48, 50 and the section 52:

$$D_2 = 2\ D_1$$

The projected angles of the arcuate sections 54, 56, in accordance with a preferred construction of the present invention, are preferably, although not necessarily, equal to one another and the sum of which is approximately 90°. In other words, the projected angle of each of the sections 54, 56 is preferably 45°.

Figure 4:
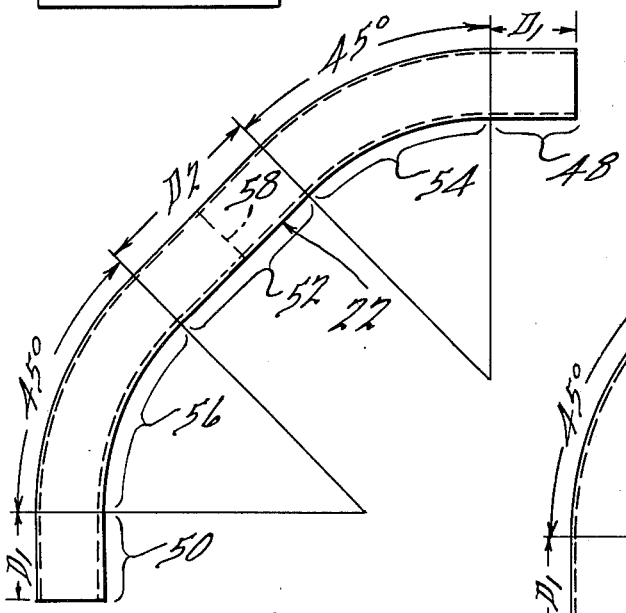
FIG. 4 is an enlarged side elevational view of a conduit structure in accordance with the principles of the present invention.
Figure 5:
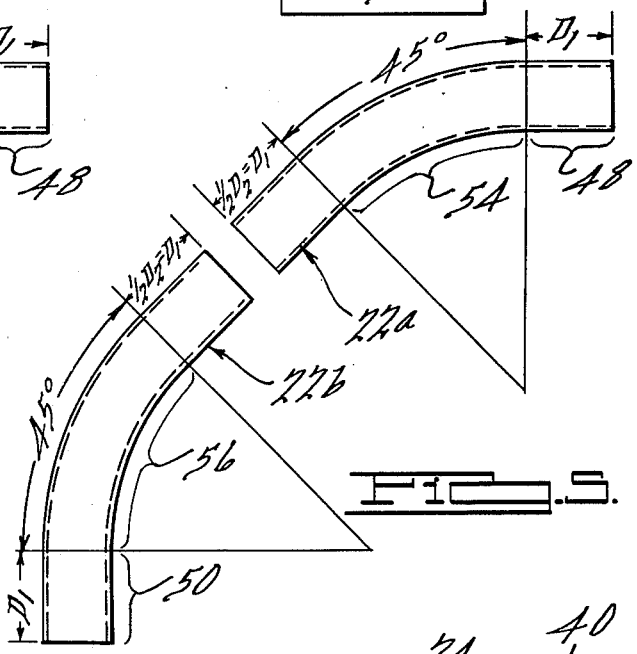
FIG. 5 is a view similar to FIG. 4 and shows the conduit structure therein after it has been severed into two separate conduit members.

In accordance with one of the primary features of the present invention, the conduit structure 22 is adapted to be severed or cut along a line extending generally transversely to the axis defining the intermediate linear section 52, as indicated at the phantom line in FIG. 4 designated by the numeral 58. When this has been done, two separate conduit sections or parts **22*a* and 22*b* are provided, as indicated in FIG. 5**, which sections

**22*a*, 22*b* are preferably identical in construction and are characterized by the fact that each of the sections comprises a central arcuate portion of 45° projected angle and a relatively linear or straight end portion at each end thereof having an axial dimension of $D_1$ or one-half $D_2$. With this arrangement, both ends of each of the sections, 22*a*, 22*b* is adapted to be operatively associated with one of the coupling assemblies 20 which require that the associated portion of the conduit that is inserted into the interior bores 28, 30** thereof be relatively straight or linear. Thus, it will be seen that the present invention provides a novel conduit structure which can effect a 90° change in direction of the ice being transmitted therethrough. In addition, the conduit structure of the present invention may be conveniently cut in half, with each resulting conduit section being adapted for operative association with a conventional coupling assembly, thereby providing for universality of application without any sacrifices in the cleanability and related maintenance thereof.

While it will be apparent that the preferred embodiment illustrated herein is well calculated to fulfill the objects above stated, it will be appreciated that the present invention is susceptible to modification, variation and change without departing from the scope of the invention.

I claim:

1. In combination in an ice making machine, means for producing a quantity of ice, an ice storage container located remote from said ice producing means, and a conduit system for communicating ice from said ice producing means to said storage container, said conduit system comprising at least one conduit structure and at least one coupling assembly for operatively connecting one end of said structure to an associated conduit element, said coupling assembly comprising first and second parts each having a portion of predetermined axial length adapted for engagement with said structure, said conduit structure being of a one-piece uniform cross-section construction and including an intermediate section and first and second opposite end sections which are of a relatively linear configuration, said first and second end sections being defined by first and second imaginary axis arranged at right angles to one another and said intermediate section being defined by a third imaginary axis arranged at a 45° angle to both said first and second axis, said conduit structure further including first and second relatively arcuate sections interposed one between said first end section and said intermediate section and the other between said intermediate section and said second end section, whereby said conduit structure can be used in an unsevered condition to provide a 90° change in direction for ice being communicated therethrough and can be severed within said intermediate section thereof to provide two separate conduit parts each having a non-linear intermediate section and relatively linear opposed end sections and each adapted to provide a 45° change in direction for ice being communicated therethrough, each of said arcuate sections being spaced axially from the terminal ends of said structure a distance at least equal to said predetermined length and being spaced from each other a distance at least as great as twice said predetermined length, said coupling assembly including a collar member adapted to be sleeved over the outer periphery of one of said end sections, said collar member having an axial bore adapted to telescopically receive said end section therewithin, with the axial length of said bore not being greater than the length of said end section.

* * * * *

UNITED STATES PATENT OFFICE

CERTIFICATE OF CORRECTION

PATENT NO. : 3,930,377

DATED : January 6, 1976

INVENTOR(S) : Robert P. Utter

It is certified that error appears in the above-identified patent and that said Letters Patent are hereby corrected as shown below:

Column 2, line 23, "Ser. No. 269,609" should be --Ser. No. 261,609--.

Signed and Sealed this

*twentieth* Day of *April 1976*

[SEAL]

*Attest:*

RUTH C. MASON
*Attesting Officer*

C. MARSHALL DANN
*Commissioner of Patents and Trademarks*